United States Patent [19]

McGuire

[11] 4,257,712

[45] Mar. 24, 1981

[54] END OF PAPER INDICATOR FOR TYPEWRITERS

[76] Inventor: Francis G. McGuire, 6863 Elm St., McLean, Va. 22101

[21] Appl. No.: 807,631

[22] Filed: Jun. 17, 1977

[51] Int. Cl.[3] ..... B41J 29/48

[52] U.S. Cl. ..... 400/708; 400/706

[58] Field of Search ..... 116/DIG. 5, DIG. 26, 116/DIG. 41; 197/189; 350/96 B; 400/706, 708

[56] References Cited

U.S. PATENT DOCUMENTS

| | | | |
|---|---|---|---|
| 1,114,633 | 10/1914 | Neidig | 197/189 |
| 3,599,586 | 8/1971 | Newman | 350/96 B X |
| 3,739,095 | 6/1973 | Alden | 350/96 B UX |
| 4,014,427 | 3/1977 | Rines | 197/189 |

*Primary Examiner*—Paul T. Sewell

*Attorney, Agent, or Firm*—Laurence R. Brown

[57] ABSTRACT

A length of light piping is formed to fit in a position in a typewriter with a pickup end viewing the contrast between the black paper roller and a light end of a paper sheet as it nears an exit position from the roller, and with a viewing end visible to the typist for sensing the end of the paper visually.

4 Claims, 4 Drawing Figures

FIG. 3
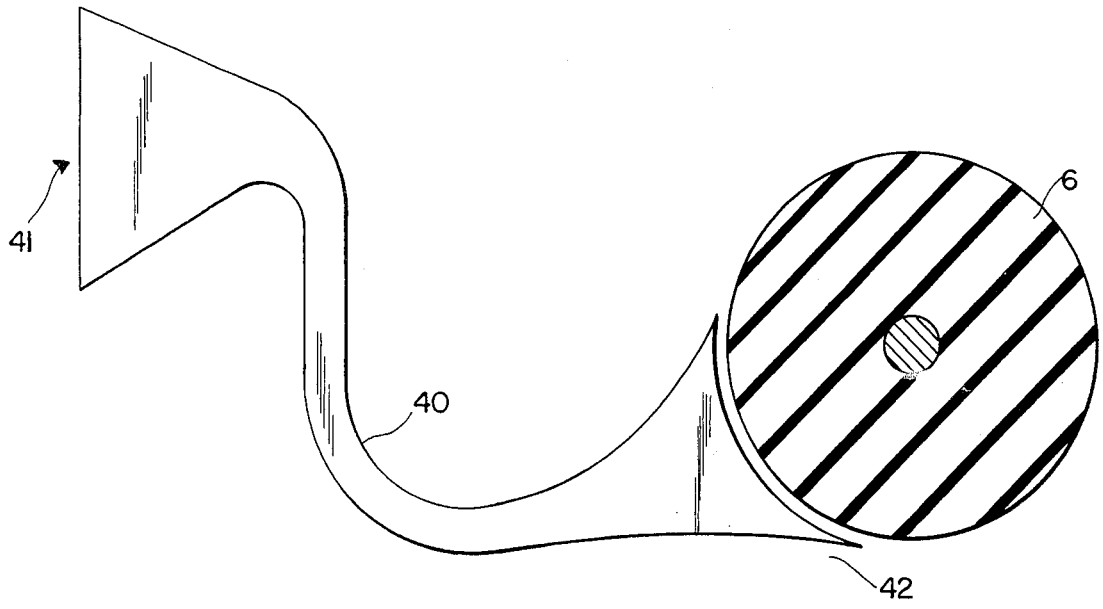
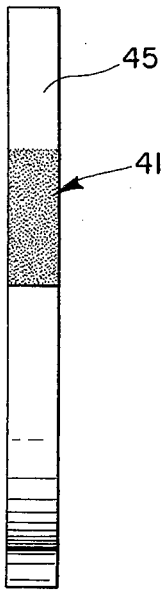
FIG. 4

END OF PAPER INDICATOR FOR TYPEWRITERS

This invention relates to typewriter accessories, and more particularly it relates to viewers indicating the bottom margin of a sheet being typed as it nears an exit position from the typewriter roller.

BACKGROUND OF THE INVENTION

Most commercial typewriters are provided with an adjustable gage that may be set for different paper lengths for estimating the end margin of a typed page. If the paper is passed too near the exit position, the roller will not hold it well enough to make a straight and neat line. If a gage is not provided, or is hard to read, the typist is disciplined as the page is being completed to roll the paper to see how many more lines may be typed. This takes time and is inefficient.

The gages are expensive mechanisms in some cases, being installed in rollers or are in other cases fragile appendage carriage extensions that need be adjusted when typing and then stored or folded when the typewriter is covered. Whenever adjustability of position at different optional margins is required, then the complexity of the mechanisms increases. There are also electrically wired margin signals such as shown in U.S. Pat. No. 3,981,388, wherein switches or photocells are wired into place and operate electric pilot lamps. Such indicators are expensive and cannot be easily installed or retrofit on existing machines in the field.

OBJECTS OF THE INVENTION

It is therefore a general object of this invention to provide an improved end of paper indicator for typewriters.

A more specific object of the invention is to provide a simplified gage that is inexpensive and easily installed without complex mechanisms or moving parts.

BRIEF DESCRIPTION OF THE INVENTION

In accordance with this invention a piece of light piping is installed with a pickup end adjacent the paper roller to view it as black unless a piece of paper is interspersed when it is white. This pickup end is disposed within the typewriter case to view the end of the sheet as it nears the exit position from the roller. The other end is disposed for viewing external to the case by the typist to see the contrast change from light to dark as the end of the paper is reached. There need be no movable or adjustable parts, and the cost of materials and installation is low.

THE DRAWING

The foregoing and further features, objects and advantages of the invention will be set forth in more detail in the following description, with reference to the accompanying drawing, wherein:

FIG. 1 is a partial view, partly in section of the paper roller portion of a typewriter, looking into the roller from the right end at a mechanism embodying the invention, FIG. 2 is a sketch of a typewriter, looking into the front as a typist does when typing, in which the invention is installed, and FIGS. 3 and 4 are respectively side and viewing end views of a light pipe constructed in accordance with another embodiment of the invention.

DETAILED DESCRIPTION OF THE INVENTION

Figure 1:
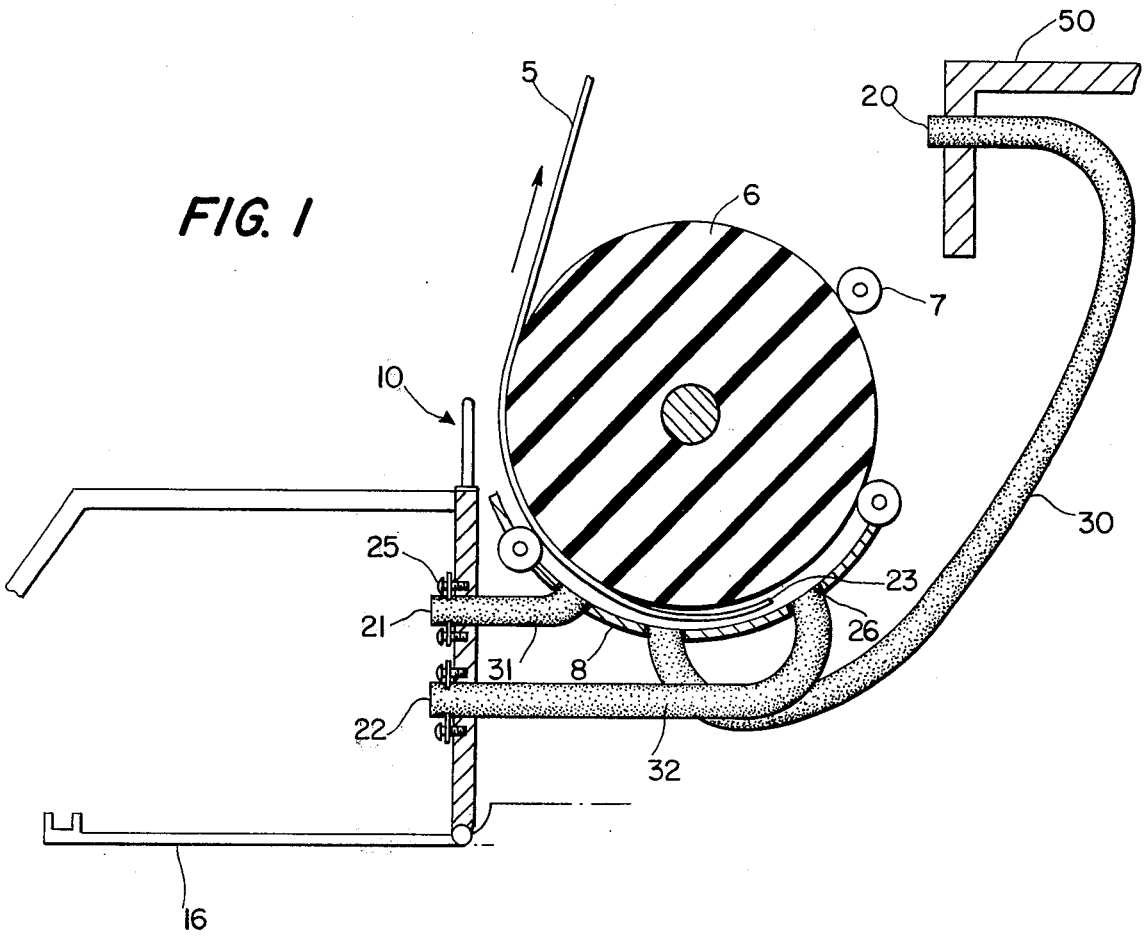
Figure 2:
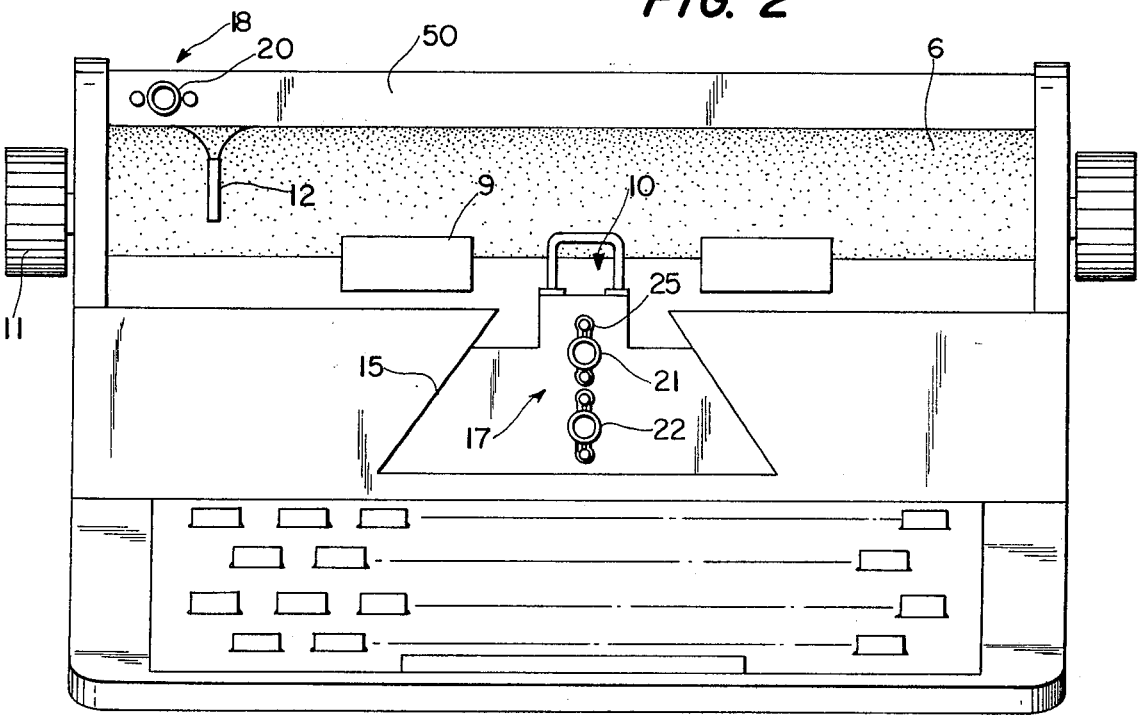

The views of FIGS. 1 and 2 schematically represent generally known commercial typewriter mechanisms. There are two types in general use, namely movable carriage and movable type versions. These views illustrate how the invention may be used with either version.

A sheet of paper 5 is carried by a large roller 6, generally of rubber and presenting a blackened outer surface. Several smaller rollers 7 and a couple of sets of retainer brackets 8, 9 guide the paper about the roller to receive an imprint of type which is at a central position 10 for movable carriage machines. Knobs 11 are used to manually advance paper and automatic line by line advancement is made by a carriage return or end of line mechanism.

Paper is aligned at a left hand margin stop 12. One difference between a movable carriage machine and a movable type machine is the view of the case and mechanism. If type moves then the striking position 10 moves from a left to right margin set in the machine. If the carriage moves, there is frequently a triangular opening 15 which permits access to type bars such as 16 sketched in FIG. 1. In the latter machines the region 17 below the typing position is generally visible and extends below the roller. In the movable type machines the triangular opening 15 need not be present, but a region 8 to the left of the paper stop will be visible to the typist.

Thus, in accordance with this invention, one or more viewers 20, 21, 22 are positioned in sight of the typist for sensing the end 23 of the sheet 5 as it prepares to exit the roller 6 at the end of a page.

These viewers 20, 21, 22 are viewing ends of corresponding light pipes 30, 31, 32, whose detailed construction are well known in the art which comprise for example, glass, plastic or fibre bundles. The pickup ends of these pipes are placed adjacent roller 6 where the paper 5 passes between the light pipe pickup ends and the roller at positions indicating the nearing of the sheet to its exit from the roller 6, as shown.

The viewing end will then display either a dark or light spot depending whether the black roller or white paper is at the pickup position, and accordingly the typist need not set or interpolate gages, make any adjustments or roll back paper to gage the end position.

The light pipes are held in position by mechanical means within the skill of mechanics in the art, exemplified herein by screw-bracket assemblies 25. The pickup ends of the light pipes also register with apertures 26 in the plate brackets 8 surrounding the roller if necessary to view unobstructed either the paper or roller. The pipes may be bent or arrayed as necessary to avoid interference with moving typewriter parts, and the shown positions are typical of those available in standard machines.

Two light pipes 31, 32 may be used if desired to show two positions for viewing a range of end-of-paper positions over the spacing of a plurality of at least two typed line spaces. Thus, the lower viewing end 22 will turn dark as the paper end 23 exits and the black roller comes into view, as a warning. The upper viewing end 21 then will subsequently turn dark as the last warning that the paper is at a typing limit margin position.

The views of FIGS. 3 and 4 show an alternative embodiment where one pipe 40 with flared viewing 41 and pickup ends 42 will serve to give a view of a range of end-of-paper positions. This type of pipe is preferably a bundle of light fibers with the two ends programmed to show corresponding positions, whereby an end of paper white portion 45 progresses across the viewing end as the last few typing line positions are encountered.

The light pipes 31, 32 might be covered for a movable type version typewriter. Therefore a viewing position 18 may be preferable by passing pipe 30 back of roller 6 to put the viewing end out of the case or cover 50 on the left hand side 18 of paper margin 12.

It is clear from the teachings of this invention that other mounting positions and variations will be suggested that do not depart from the Spirit of the invention.

Those novel features believed descriptive of the nature of the invention are set forth with particularity in the appended claims.

What is claimed is:

1. A typewriter mechanism, comprising in combination, a dark paper roller, a housing, and a wireless end of paper indicator operable in a mode sensing surface contrast between a paper roller and paper consisting of a length of light piping disposed between (a) a first position at one pickup end viewing the surface of the paper roller at a position where a paper sheet carried thereby is interposed between the pickup end and the roller until it nears an exit position from the roller thereby to indicate by contrast in color that the paper edge is nearing the end of a typed page, and (b) a second position at the other viewing end disposed in said housing for visibility by a typist when typing on said typewriter, whereby the contrast between the dark paper roller and a light paper sheet indicates by light carried to the viewing end of the light pipe the presence or absence of a sheet of paper between the roller and the pickup end.

2. A mechanism as defined in claim 1 wherein the light piping comprises a spread out portion at the pickup end encompassing a range of positions over a plurality of typed line spacings on the paper and corresponding spread out over a range of positions at the other viewing end to convey said contrast over said range as the end of a sheet of paper passes the pickup end and travels through said plurality of spacings.

3. A mechanism as defined in claim 2 wherein said light piping comprises a bundle of light fibers spread out at the ends from a bundle therebetween.

4. A wireless end of paper indicator for a typewriter consisting of a length of light piping formed to take a position in said typewriter between a typist viewing position and a sensing position that the end of a sheet of paper carried by an advancing roller in the typewriter takes near the exit of the sheet from the typewriter to thereby present to the sensing position a color contrast between the roller and the paper which in turn is viewed at the viewing position by transmission through said pipe.

* * * * *